US010193220B2

(12) United States Patent
Lee et al.

(10) Patent No.: US 10,193,220 B2
(45) Date of Patent: Jan. 29, 2019

(54) ANTENNA ARRAY

(71) Applicant: ELECTRONICS AND TELECOMMUNICATIONS RESEARCH INSTITUTE, Daejeon (KR)

(72) Inventors: Juyul Lee, Daejeon (KR); Jinup Kim, Daejeon (KR); Myung-Don Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 321 days.

(21) Appl. No.: 15/064,952

(22) Filed: Mar. 9, 2016

(65) Prior Publication Data

US 2016/0308283 A1 Oct. 20, 2016

(30) Foreign Application Priority Data

Apr. 16, 2015 (KR) ..... 10-2015-0053560

(51) Int. Cl.
*H01Q 1/52* (2006.01)

(52) U.S. Cl.
CPC ..... *H01Q 1/523* (2013.01)

(58) Field of Classification Search
None
See application file for complete search history.

(56) References Cited

U.S. PATENT DOCUMENTS

| | | | | |
|---|---|---|---|---|
| 5,568,160 | A | 10/1996 | Collins | |
| 2006/0164317 | A1* | 7/2006 | Hughes | H01Q 1/523 343/841 |
| 2012/0092219 | A1 | 4/2012 | Kim | |
| 2012/0287008 | A1 | 11/2012 | Kim | |
| 2014/0266953 | A1* | 9/2014 | Yen | H01Q 9/065 343/818 |

OTHER PUBLICATIONS

Zhou et al., "*Improved Two-Antenna Direction Finding Inspired by Human Ears*," in IEEE Transactions on Antennas and Propagation, vol. 59, No. 7, pp. 2691-2697, Jul. 2011. (7 Pages in English).

* cited by examiner

*Primary Examiner* — Daniel J Munoz
*Assistant Examiner* — Noel Maldonado
(74) *Attorney, Agent, or Firm* — NSIP Law

(57) ABSTRACT

Disclosed is an antenna array, including: a first antenna; a second antenna; and a dielectric substance, of which a height is determined based on a distance between the first and second antennas and forms of beam patterns of the first and second antennas. According to the antenna array according to the exemplary embodiments of the present invention, it is possible to decrease coupling between the antennas.

8 Claims, 5 Drawing Sheets

ANTENNA ARRAY

CROSS-REFERENCE TO RELATED APPLICATIONS

This application claims priority to and the benefit of Korean Patent Application No. 10-2015-0053560 filed in the Korean Intellectual Property Office on Apr. 16, 2015, the entire contents of which are incorporated herein by reference.

TECHNICAL FIELD

The present invention relates to an antenna array.

BACKGROUND ART

In general, an antenna array including a dipole multi-antenna estimates a direction of a received beam by using a phase delay according to an incident angle of the beam. That is, the beam incident into the antenna array generates a predetermined distance delay between the adjacent antennas, and when a gap between the antennas and a phase difference between the antennas are used, it is possible to estimate an incident angle of the received beam. However, in a case of the dipole antenna, a beam pattern heads in an omni-direction, so that there is a disadvantage in that a plurality of antennas needs to be used in order to estimate a direction of the incident beam.

As a method for solving the disadvantage, a directional antenna having a directional beam pattern is used. When the directional antenna is used, it is possible to estimate an incident angle by using size information (for example, power) and beam pattern information about the received beam. However, when the directional antennas are arranged in an array form, beams overlap according to a distance between the antennas, so that there is a problem in that the coupling occurs.

SUMMARY OF THE INVENTION

The present invention has been made in an effort to provide an antenna array, which is capable of decreasing coupling between antennas.

Technical objects of the present invention are not limited to the aforementioned technical objects and other technical objects which are not mentioned will be apparently appreciated by those skilled in the art from the following description.

An exemplary embodiment of the present invention provides an antenna array, including: a first antenna; a second antenna; and a dielectric substance, of which a height is determined based on a distance between the first and second antennas and forms of beam patterns of the first and second antennas.

The beam patterns of the first and second antennas may include beam widths of main lobes.

The beam widths of the main lobes of the first and second antennas may be the same as each other.

When the distance between the first and second antennas is smaller than two times the beam widths of the main lobes of the first and second antennas, the height of the dielectric substance may be determined by lengths from distal ends of the first and second antennas to a point defining the beam width.

When the distance between the first and second antennas is equal to or larger than two times the beam widths of the main lobes of the first and second antennas, the height of the dielectric substance may be determined based on lengths of side lobes of the first and second antennas.

The lengths of the side lobes of the first and second antennas may be the same as each other.

The dielectric substance may be disposed between the first antenna and the second antenna.

The first antenna and the second antenna may be directional antennas.

Another exemplary embodiment of the present invention provides an antenna array, including: a first antenna; a second antenna; and a dielectric substance disposed between the first and second antennas, and extended from distal ends of the first and second antennas by a length determined based on a distance between the first and second antennas and beam widths of main lobes of the first and second antennas.

The beam widths of the main lobes of the first and second antennas may be the same as each other.

When the distance between the first and second antennas is smaller than two times the beam widths of the main lobes of the first and second antennas, the dielectric substance may be extended from the distal ends of the first and second antennas by the lengths from the distal ends of the first and second antennas to the point defining the beam width.

When the distance between the first and second antennas is equal to or larger than two times the beam widths of the main lobes of the first and second antennas, the dielectric substance may be extended from the distal ends of the first and second antennas by lengths of side lobes of the first and second antennas.

The lengths of the side lobes of the first and second antennas may be the same as each other.

The first antenna and the second antenna may be directional antennas.

According to the antenna array according to the exemplary embodiments of the present invention, it is possible to decrease coupling between the antennas.

Further, according to the antenna array according to the exemplary embodiments of the present invention, it is possible to improve accuracy in estimating a direction of a beam of a beam direction estimating device.

Figure 1:
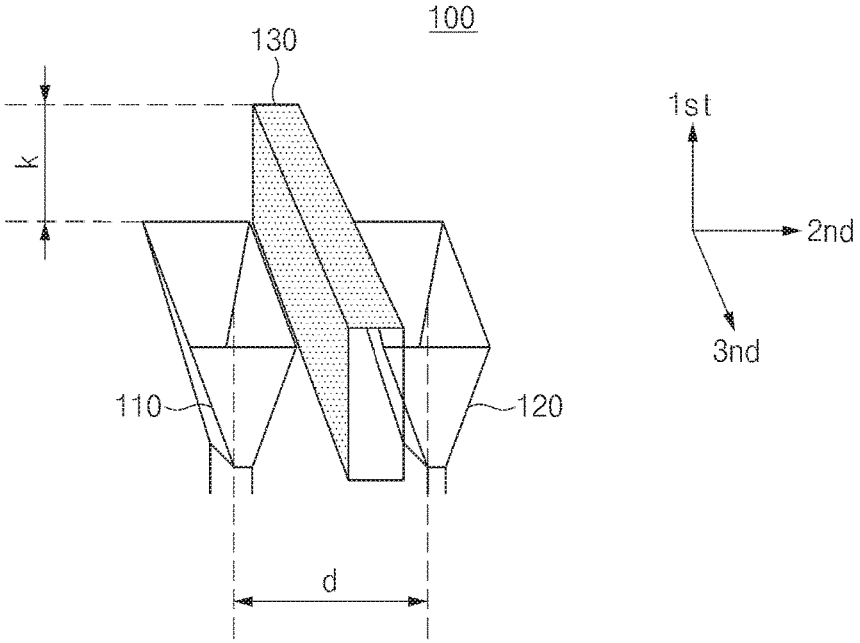
FIG. 1 is a diagram illustrating an antenna array according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, some exemplary embodiments of the present invention will be described in detail with reference to the accompanying drawings. When reference numerals refer to elements of each drawing, it is noted that although the same elements are illustrated in different drawings, the same elements are referred to by the same reference numerals as possible. Further, in describing the exemplary embodiments of the present invention, when it is determined that the detailed description of known configurations or functions related to the present invention may obscure the understanding of the exemplary embodiment of the present invention, the detailed description thereof will be omitted.

In describing constituent elements of the exemplary embodiment of the present invention, terms such as first, second, A, B, (a), (b), and the like may be used. Such a term is only for discriminating the constituent element from another constituent element, and does not limit the essential feature, order, or sequence of the constituent element, or the like. Further, if it is not contrarily defined, all terms used herein including technological or scientific terms have the same meaning as those generally understood by those skilled in the art. Terms which are defined in a generally used dictionary should be interpreted to have the same meaning as the meaning in the context of the related art but are not interpreted as ideal or excessively formal meaning if it is not clearly defined in the present invention.

Figure 2:
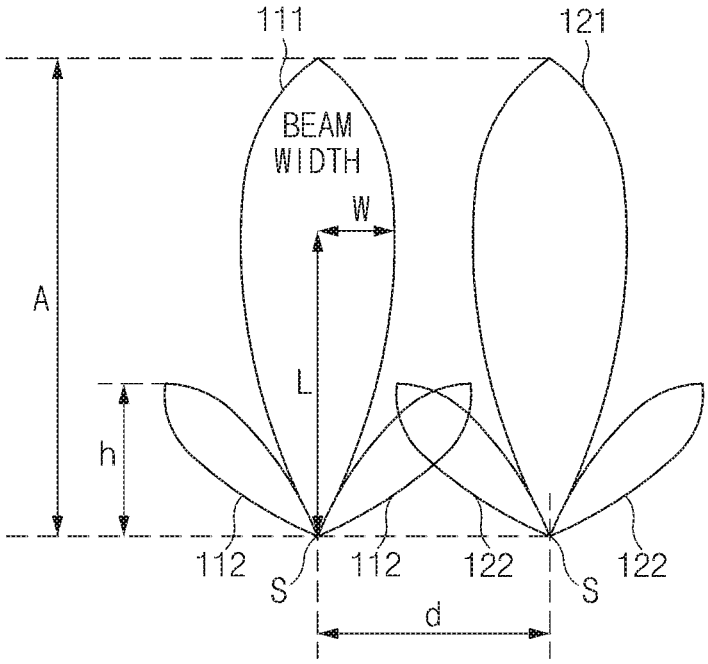
FIG. 2 is a diagram illustrating a beam pattern of the antenna array according to the exemplary embodiment of the present invention.

FIG. 1 is a diagram illustrating an antenna array according to an exemplary embodiment of the present invention. FIG. 2 is a diagram illustrating a beam pattern of the antenna array according to the exemplary embodiment of the present invention.

Referring to FIGS. 1 and 2, an antenna array 100 according to the exemplary embodiment of the present invention includes a first antenna 110, a second antenna 120, and a dielectric substance 130. Hereinafter, it is assumed that distal ends of the first antenna 110 and the second antenna 120 are positioned at the same level.

The first antenna 110 and the second antenna 120 may form beam patterns. The beam patterns of the first antenna 110 and the second antenna 120 may be the same as each other. For example, the first antenna 110 may form a beam pattern including a main lobe 111 and a side lobe 112, and the second antenna 120 may form a beam pattern including a main lobe 121 and a side lobe 122. For example, the beam patterns of the first antenna 110 and the second antenna 120 may be formed in a first direction $1^{st}$.

The main lobe 111 of the first antenna 110 and the main lobe 121 of the second antenna 120 may have the same length A and the same beam width W. The beam widths W of the main lobe 111 of the first antenna 110 and the main lobe 121 of the second antenna 120 may be defined at a point spaced apart from a reference point s by a predetermined distance L. The side lobe 112 of the first antenna 110 and the side lobe 122 of the second antenna 120 may have the same length h.

The first antenna 110 and the second antenna 120 may be directional antennas. FIG. 1 illustrates that the first antenna 110 and the second antenna 120 are horn antennas, but the present invention is not limited thereto.

The dielectric substance 130 may be disposed between the first antenna 110 and the second antenna 120. The dielectric substance 130 may be disposed in a form extended from the distal ends of the first antenna 110 and the second antenna 120 by a predetermined height k in the first direction $1^{st}$. FIG. 1 illustrates that the dielectric substance 130 has, for example, a rectangular parallelepiped shape, but is not limited thereto, and the shape of the dielectric substance 130 may be variously determined in consideration of the forms of the first antenna 110 and the second antenna 120.

A height k of the dielectric substance 130 may be determined based on the distance d between the first antenna 110 and the second antenna 120 and the beam widths W of the main lobes 111 and 121 of the first antenna 110 and the second antenna 120. For example, the height of the dielectric substance 130 may be defined as Equation 1 below.

$$k = \begin{cases} L & \text{if } d < 2W \\ h & \text{if } d \geq 2W \end{cases} \quad \text{[Equation 1]}$$

Herein, k represents a height of the dielectric substance 130, L represents a length L from the reference point s to a point defining the beam width W of the main lobe 111, d represents a distance between the first antenna 110 and the second antenna 120, and h represents a length of the side lobe 112.

Referring to Equation 1, the height k of the dielectric substance 130 may be determined by the length L from the reference point s to the point defining the beam width W of the main lob 111 when the distance d between the first antenna 110 and the second antenna 120 is smaller than two times the beam widths W of the main lobes 111 and 121 of the first antenna 110 and the second antenna 120.

The height k of the dielectric substance 130 may be determined by the length h of the side lobes 112 and 122 of the first antenna 110 and the second antenna 120 when the distance d between the first antenna 110 and the second antenna 120 is equal to or larger than two times the beam widths W of the main lobes 111 and 121 of the first antenna 110 and the second antenna 120.

However, it shall be understood that Equation 1 is illustrative, and the height k of the dielectric substance 130 may be determined by various values capable of decreasing coupling between the first antenna 110 and the second antenna 120.

In one aspect, it may be understood that in Equation 1, the height k of the dielectric substance 130 when the distance d between the first antenna 110 and the second antenna 120 is smaller than a threshold value has a larger value than that of the height k of the dielectric substance 130 when the distance d between the first antenna 110 and the second antenna 120 is equal to or larger than the threshold value.

In another aspect, it may be understood that in Equation 1, the height k of the dielectric substance 130 has a larger value when the distance d between the first antenna 110 and the second antenna 120 has a smaller value.

As described above, the antenna array 100 according to the exemplary embodiment of the present invention includes the dielectric substance 130, of which the height is determined based on the distance d between the first antenna 110 and the second antenna 120 and the beam widths W of the main lobes 111 and 121 of the first antenna 110 and the second antenna 120, between the first antenna 110 and the second antenna 120, thereby decreasing coupling by interference of the beams between the first antenna 110 and the second antenna 120.

In the antenna array 100 according to the exemplary embodiment of the present invention, the dielectric substance 130 is disposed between the first antenna 110 and the second antenna 120, thereby improving a connection between the first antenna 110 and the second antenna 120 and improving durability.

Figure 3:
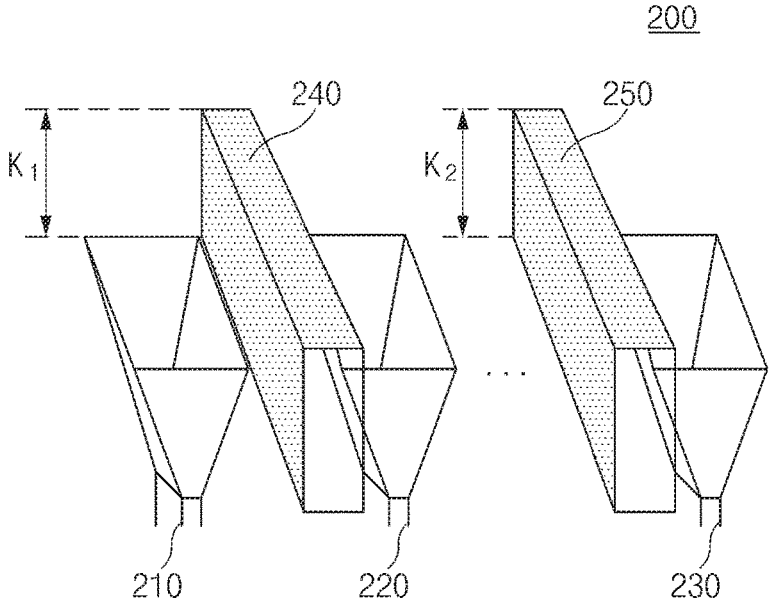
FIG. 3 is a diagram illustrating an antenna array according to another exemplary embodiment of the present invention.

FIG. 3 is a diagram illustrating an antenna array according to another exemplary embodiment of the present invention.

Referring to FIG. 3, an antenna array 200 according to another exemplary embodiment of the present invention may include a plurality of antennas 210, 220, and 230, and a plurality of dielectric substances 240 and 250.

The plurality of dielectric substances 240 and 250 may be disposed between the plurality of antennas 210, 220, and 230. For example, a height k1 of the dielectric substance 240 may be determined based on a distance between the plurality of antennas 210 and 220 and beam widths of main lobes of the plurality of antennas 210 and 220. For example, the height k1 of the dielectric substance 240 and a height k2 of the dielectric substance 250 may have difference values according to a disposition of the plurality of antennas 210, 220, and 230.

In general, the antenna array decreases mutual coupling by disposing the plurality of antennas to be spaced apart from each other by a gap of a half-wave length or more, but according to the antenna array 100 (see FIG. 1) and the antenna array 200 according to the exemplary embodiments of the present invention, it is possible to decrease coupling between the plurality of antennas through the dielectric substances 130, 240, and 250, so that it is possible to more freely dispose the antennas.

Figure 4:
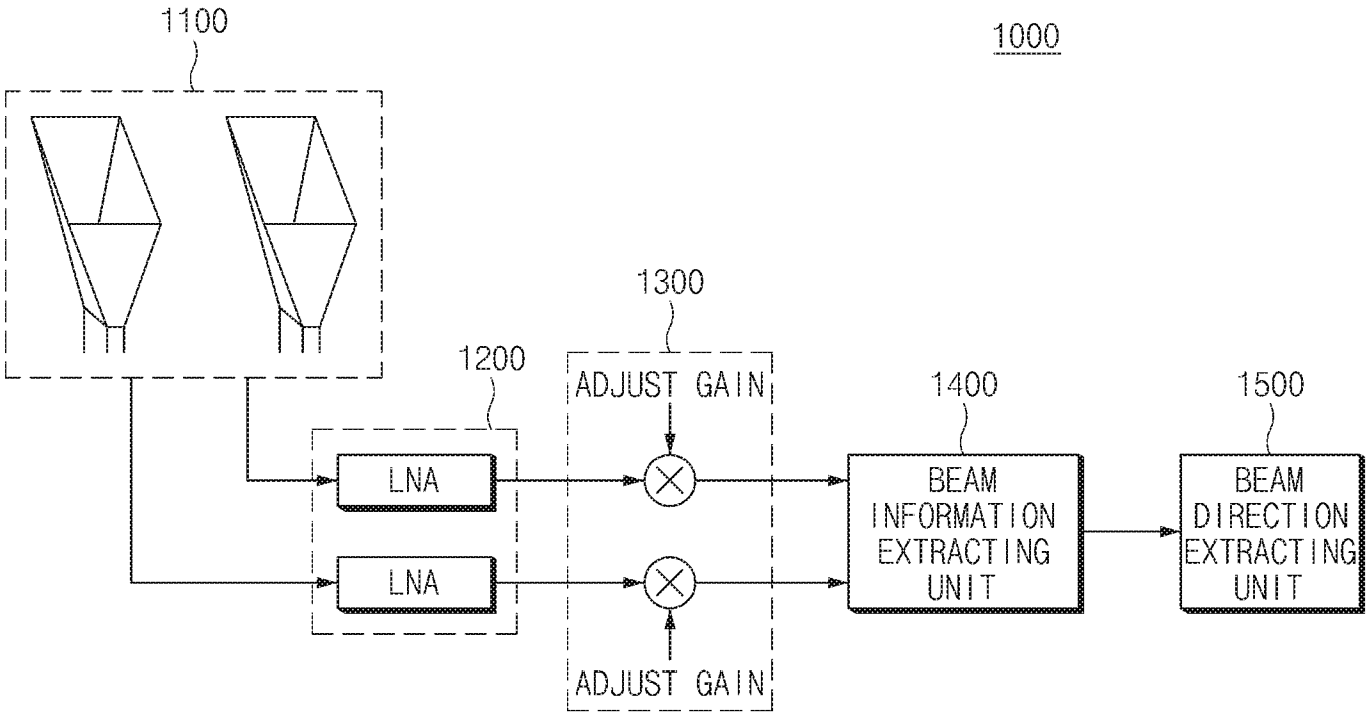
FIG. 4 is a diagram illustrating a beam direction estimating device using the antenna array according to the exemplary embodiment of the present invention.

FIG. 4 is a diagram illustrating a beam direction estimating device using the antenna array according to the exemplary embodiment of the present invention.

Referring to FIG. 4, a beam direction estimating device 1000 according to the exemplary embodiment of the present invention may include an antenna array 1100 including a plurality of antennas receiving beams, a low-noise amplifier 1200 amplifying the received beam, a gain adjusting unit 1300 adjusting a gain of the amplified beam, a beam information extracting unit 1400 extracting a phase and a size from the beam transmitted from the gain adjusting unit 1300, and a beam direction estimating unit 1500 estimating a direction of the beam based on the extracted beam information.

For example, the antenna array 1000 may be the antenna array 100 or 200 described with reference to FIG. 1 or 3.

As described with reference to FIGS. 1 to 3, the antenna arrays 100 and 200 according to the exemplary embodiment of the present invention include the dielectric substances 130, 240, and 250 and thus it is possible to decrease coupling by interference of the beam between the antennas, so that accuracy in estimation by the beam direction estimating device 1000 according to the exemplary embodiment of the present invention may be improved.

Figure 5:
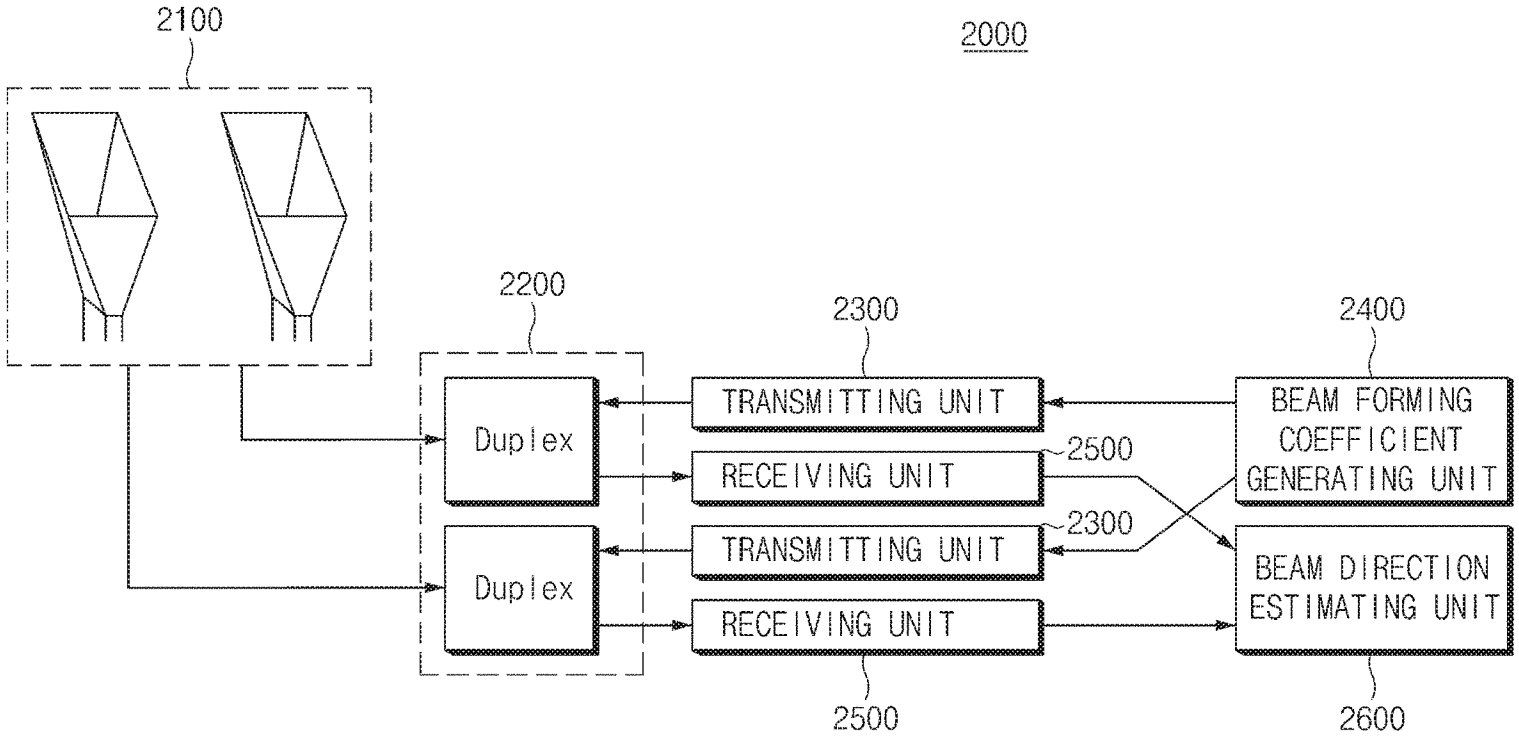
FIG. 5 is a diagram illustrating a beam transceiving device using the antenna array according to the exemplary embodiment of the present invention.

FIG. 5 is a diagram illustrating a beam transceiving device using the antenna array according to the exemplary embodiment of the present invention.

Referring to FIG. 5, a beam transceiving device 2000 according to the exemplary embodiment of the present invention may include an antenna array 2100 including a plurality of antennas receiving beams, a duplex 2200, a transmitting unit 2300, a beam forming coefficient generating unit 2400, a receiving unit 2500, and a beam direction estimating unit 2600.

For example, the antenna array 2000 may be the antenna array 100 or 200 described with reference to FIG. 1 or 3.

The transmitting unit 2300 may generate a beam by using coefficient information received from the beam forming coefficient generating unit 2400, and transmit the generated beam through the antenna array 2100.

The beam forming coefficient generating unit 2400 may generate coefficient information (for example, a phase and/or a size) for forming a beam.

The receiving unit 2500 may include the low-noise amplifier 1200, the gain adjusting unit 1300, and the beam information extracting unit 1400 which are described with reference to FIG. 4. The receiving unit 2500 and the beam direction estimating unit 2600 may be the same as those described with reference to FIG. 4.

The above descriptions are simply given for illustratively describing the technical spirit of the present invention, and those skilled in the art may variously change and modify the present invention in various ways without departing from the essential characteristic of the present invention.

Accordingly, the exemplary embodiments disclosed herein are not intended to limit the technical spirit but describe the technical spirit of the present invention, and the scope of the technical spirit of the present invention is not limited by the exemplary embodiment. The scope of the present invention should be construed based on the following appended claims and it should be appreciated that the technical spirit included within the scope equivalent to the claims belongs to the scope of the present invention.

What is claimed is:

1. An antenna array, comprising:

a first antenna;

a second antenna; and a dielectric substance, of which a height is determined based on a distance between the first and second antennas and beam widths of main lobes of the first and second antennas, wherein when the distance between the first and second antennas is smaller than two times the beam widths of the main lobes of the first and second antennas, the height of the dielectric substance is determined by lengths from distal ends of the first and second antennas to a point defining the beam width.

2. The antenna array of claim 1, wherein the beam widths of the main lobes of the first and second antennas are the same as each other.

3. The antenna array of claim 1, wherein the dielectric substance is disposed between the first antenna and the second antenna.

4. The antenna array of claim 1, wherein the first antenna and the second antenna are directional antennas.

5. An antenna array, comprising:

a first antenna;

a second antenna; and a dielectric substance, of which a height is determined based on a distance between the first and second antennas and beam widths of main lobes of the first and second antennas, wherein when the distance between the first and second antennas is equal to or larger than two times the beam widths of the main lobes of the first and second antennas, the height of the dielectric substance is determined based on lengths of side lobes of the first and second antennas.

6. The antenna array of claim 5, wherein the beam widths of the main lobes of the first and second antennas are the same as each other.

7. The antenna array of claim 5, wherein the lengths of the side lobes of the first and second antennas are the same as each other.

8. The antenna array of claim 5, wherein the first antenna and the second antenna are directional antennas.

* * * * *